US006259079B1

(12) United States Patent
Ji et al.

(10) Patent No.: US 6,259,079 B1
(45) Date of Patent: Jul. 10, 2001

(54) MICROWAVE FOOD PACKAGE AND METHOD

(75) Inventors: Hong Ji, Woodbury; Randal J. Monforton, Eden Prairie, both of MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/484,283

(22) Filed: Jan. 18, 2000

(51) Int. Cl.[7] ..... H05B 6/80
(52) U.S. Cl. ..... 219/727; 219/729
(58) Field of Search ..... 219/725, 727, 219/728, 729, 730, 731, 734, 745, 759; 99/DIG. 14; 426/107, 109, 234, 241, 243

(56) References Cited

U.S. PATENT DOCUMENTS

| | | | | |
|---|---|---|---|---|
| 3,219,460 | | 11/1965 | Brown | 99/192 |
| 4,080,524 | | 3/1978 | Greenfield et al. | 219/10.55 E |
| 4,081,646 | | 3/1978 | Goltsos | 219/10.55 E |
| 4,144,435 | * | 3/1979 | Clark et al. | 219/729 |
| 4,144,438 | | 3/1979 | Gelman et al. | 219/10.55 E |
| 4,190,757 | | 2/1980 | Turpin et al. | 219/10.55 E |
| 4,196,331 | | 4/1980 | Leveckis et al. | 219/10.55 E |
| 4,204,105 | | 5/1980 | Leveckis et al. | 219/10.55 E |
| 4,228,334 | | 10/1980 | Clark et al. | 219/10.55 E |
| 4,268,738 | | 5/1981 | Flautt, Jr. et al. | 219/10.55 F |
| 4,656,325 | | 4/1987 | Keefer | 219/10.55 E |
| 4,676,857 | | 6/1987 | Scharr et al. | 156/233 |
| 4,689,458 | | 8/1987 | Levendusky et al. | 219/10.55 E |
| 4,703,148 | | 10/1987 | Mikulski et al. | 219/10.55 E |
| 4,734,288 | | 3/1988 | Engstrom et al. | 426/107 |
| 4,777,053 | | 10/1988 | Tobelmann et al. | 426/107 |
| 4,810,844 | | 3/1989 | Anderson | 219/10.55 E |
| 4,865,921 | | 9/1989 | Hollenberg et al. | 428/461 |
| 4,866,234 | | 9/1989 | Keefer | 219/10.55 E |
| 4,870,233 | | 9/1989 | McDonald et al. | 219/10.55 E |
| 4,888,459 | | 12/1989 | Keefer | 219/10.55 E |
| 4,908,246 | | 3/1990 | Fredricks et al. | 428/34.1 |
| 4,915,780 | | 4/1990 | Beckett | 156/661.1 |
| 4,927,991 | | 5/1990 | Wendt et al. | 219/10.55 E |
| 4,962,000 | | 10/1990 | Emslander et al. | 428/461 |
| 4,972,059 | | 11/1990 | Wendt et al. | 219/10.55 E |

(List continued on next page.)

FOREIGN PATENT DOCUMENTS 2098184 6/1997 (CA) .

OTHER PUBLICATIONS

Article, "Better susceptor heats up for microwave pizza", Packaging Digest, Aug. 1995.
Article, "Historical and Recent Attempts to Solve Microwave Heating Problems with Packaging", vol. 13, No. 1—Summer 1992.
Article, "A Microwave Oven Model, Examples of Microwave Heating Computations", Microwave World, vol. 19, No. 1—Summer 1998.
Article, "You Can Use Metal In a Microwave Oven", Microwave World, vol. 13, No. 1—Summer 1992.

(List continued on next page.)

*Primary Examiner*—Tu Ba Hoang
(74) *Attorney, Agent, or Firm*—John M. Haurykiewicz; Douglas J. Taylor

(57) ABSTRACT

Apparatus for and method of controlling heating of a foodstuff using microwave energy having a food package with a microwave shielding layer containing a plurality of apertures therein sized to permit entry of both evanescent microwave energy and propagating microwave energy into the interior of the package with the microwave shielding layer being moved outward as the package expands due to generation of water vapor such that an interior volume of the package is subsequently protected against substantial evanescent microwave irradiation of the foodstuff during completion of the microwave heating cycle using propagating microwave energy to further heat the foodstuff.

33 Claims, 14 Drawing Sheets

U.S. PATENT DOCUMENTS

| | | | |
|---|---|---|---|
| 4,985,606 | 1/1991 | Faller | 219/10.55 E |
| 5,006,684 | 4/1991 | Wendt et al. | 219/10.55 E |
| 5,012,068 | 4/1991 | Anderson | 219/10.55 M |
| 5,038,009 | 8/1991 | Babbitt | 219/10.55 E |
| 5,039,364 | 8/1991 | Beckett et al. | 156/60 |
| 5,059,279 | 10/1991 | Wilson | 156/651 |
| 5,081,330 | 1/1992 | Brandberg et al. | 219/10.55 E |
| 5,117,078 | 5/1992 | Beckett | 219/10.55 E |
| 5,124,519 | 6/1992 | Roy et al. | 219/10.55 E |
| 5,164,562 | 11/1992 | Huffman et al. | 219/10.55 E |
| 5,185,506 | 2/1993 | Walters | 219/10.55 E |
| 5,254,821 | 10/1993 | Walters | 219/10.55 E |
| 5,256,846 | 10/1993 | Walters | 219/10.55 E |
| 5,260,537 | 11/1993 | Beckett | 219/10.55 E |
| 5,300,746 | 4/1994 | Walters et al. | 219/745 |
| 5,331,135 | 7/1994 | Ovadia | 219/728 |
| 5,354,973 | 10/1994 | Beckett | 219/730 |
| 5,391,430 | 2/1995 | Fabish et al. | 428/328 |
| 5,412,187 | 5/1995 | Walters et al. | 219/728 |
| 5,468,939 | 11/1995 | MacLean, IV | 219/727 |
| 5,489,766 | 2/1996 | Walters et al. | 219/730 |
| 5,519,195 | 5/1996 | Keefer et al. | 219/728 |
| 5,928,555 * | 7/1999 | Kim et al. | 219/729 |

OTHER PUBLICATIONS

*Classical Electrodynamics*, John David Jackson, Second Edition, 1962, 1975; Chapter 8 "Wave Guides and Resonant Cavities", pp. 335–375; Sep. 9.11 "Simple Radiating Systems, Scattering, and Diffraction", pp. 438–441.

*Dielectrics and Waves*, Arthur R. Von Hippel, 1954, "Guided Waves", pp. 67–73.

*Microwave Cooking and Processing*, Charles R. Buffler, PhD, 1993, Chapter 7 "Packaging Containers, and Susceptors", pp. 84–95.

* cited by examiner

MICROWAVE FOOD PACKAGE AND METHOD

FIELD OF THE INVENTION

This invention relates to the field of microwave heating of foodstuffs, in particular to packaging designed for influencing the heating of the foodstuff as it is irradiated with microwave energy. More particularly, the present invention relates to the use of both evanescent and propagating microwave energy to control heating of foodstuffs.

BACKGROUND OF THE INVENTION

With respect to microwave foods, it is often desirable that the microwave heating be controlled in order to prevent overheating of the food. One example is microwave heating and popping of popcorn. If popped kernels are subjected to prolonged microwave heating, scorching occurs. Currently, microwave popcorn is packaged in flexible paper bags. Embedded in the popcorn bag is a susceptor used to absorb microwave energy and aid popcorn heating and popping. Typically in packaging microwave popcorn, a slurry including popcorn kernels are located on top of the susceptor, the bag is folded over itself to a compact size. When the bag is placed in the microwave oven, instructions typically call for at least partial unfolding of the bag and placing the bag on a microwave transparent shelf or floor of the oven with the susceptor below the popcorn. When the popcorn bag is heated in the microwave oven, steam or water vapor from the popping popcorn causes the bag to further unfold and inflate. With the current bag designs, popped kernels are unprotected from microwave irradiation after popping. When heated above about 210° C., popped kernels begin to scorch. The present invention overcomes this shortcoming of prior art popcorn bags (and other microwave-related food packages) by providing a bag or package that initially exposes the popcorn (or other food load) to a controlled combination of both propagating and non-propagating (evanescent) microwave irradiation to pop the kernels or otherwise heat the food load and thereafter reduces the microwave irradiation to the bulk of the popped kernels (or other heated food load), to reduce the possibility of scorching (and other undesirable results of overheating) that would otherwise occur. When a popcorn load is referred to herein, it is to be understood that it generally refers to a load that includes a popcorn kernel hybrid engineered for desired agronomic and microwave popping properties and consistent with generally available major commercially available microwave popcorn offerings, together with a butter type slurry having major constituents of soybean oil, salt, colorings, flavorings and the like. These components combine (in a typical load) to a weight of approximately 100 grams with about 80% or more (by weight) being the popcorn kernels themselves.

DETAILED DESCRIPTION OF THE INVENTION

Figure 1:
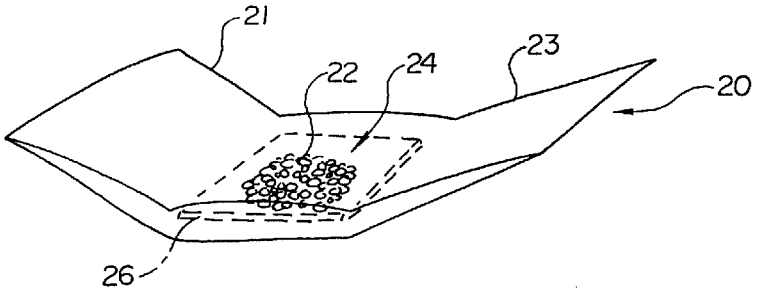
FIG. 1 is a perspective view of a popcorn bag useful in the practice of the present invention shown in a first state prior to popping under the influence of microwave irradiation.

Referring now to the Figures, and most particularly, to FIGS. 1, 2, 11, 12, 15 and 16,a food package 20 useful in the practice of the present invention may be seen. Food package 20 is in the form of a modified conventional microwave popcorn bag having wings 21, 23 in which the unpopped popcorn 22 is vended or sold for consumers to place in a microwave oven and pop the popcorn. It is to be understood that the unpopped popcorn load 22 typically will include fat, oil, salt, colorings, flavorings or the like in addition to the popcorn kernels, forming a mass or slurry 24, typically positioned on a microwave susceptor 26. Susceptor 26 may be a conventional susceptor as is well known to use for microwave heating, especially for popping popcorn.

In the practice of the present invention, it has been found desirable to admit both evanescent, or non-propagating, microwave energy and propagating microwave energy into the interior of the food package, with both forms of energy controlled by the package. By allowing controlled entry of the propagating and non-propagating (evanescent) microwave energy inside the food package, the total performance of the food package can be balanced. Using both propagating and non-propagating energy allows more control over the simultaneous reduction of scorching, improvement in popping volume and unpopped kernel reduction. For the purpose of reducing scorching, one would ordinarily minimize propagating energy and reduce the depth of evanescent energy penetration into the food package. However, to maintain or even improve popping volume or to reduce unpopped kernels, it may be desirable to utilize a certain fraction of propagating wave energy in addition to using evanescent energy in a controlled fashion as is described herein.

It is believed desirable to use propagating energy throughout the heating cycle when the load is characterized by a substantial mass or bulk that is not agitated or dispersed (in contrast to popcorn). An example is to use propagating energy to heat the center of food such as a pie. With a pie, for example, it may be desirable to utilize evanescent energy to heat or brown the crust of the pie.

Figure 5:
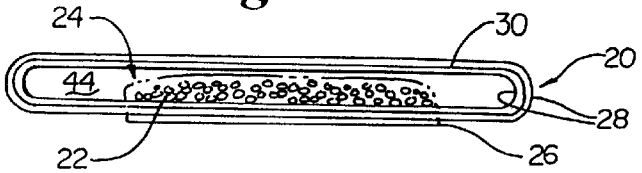
FIG. 5 is a schematic or simplified pictorial view of a generic version of the bag of FIG. 1 corresponding to the first state to illustrate certain features of the present invention.
Figure 6:
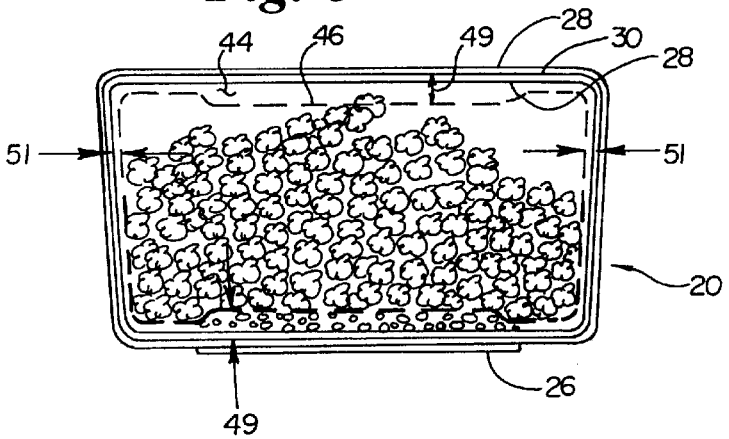
FIG. 6 is a schematic or simplified pictorial view of a generic version of the bag of FIG. 2 corresponding to the second state to illustrate certain aspects of the present invention.

Referring now also to FIGS. 5 and 6, as well as the Figures already referred to, in this embodiment the package 20 is preferably a flexible, inflatable bag. Bag or package 20 can be made from any desired material but is preferably formed of paper, one or more polymers, or a combination thereof, including but not limited to base coated paper or similar polymer structures or the like. It is to be understood that FIGS. 5 and 6 show an "idealized" package to illustrate certain aspects of the invention.

The package 20 preferably includes one or more septic layers 28 such as paper or plastic to provide a clean or sanitary environment and a suitable external appearance for the foodstuff during vending and handling. In addition, as part of the septic layer, (or as a separate layer) package 20 also has a water vapor barrier layer (e.g., interior layer 28) for reasons which will become apparent. It is to be understood that the water vapor barrier layer is desirably similar or identical to that used in conventional popcorn packaging intended for use heating in microwave ovens. It is to be further understood that this layer is sealed sufficiently to cause or allow the bag to inflate as is conventional in the microwave popping of popcorn, for reasons to be explained infra.

Figure 3:
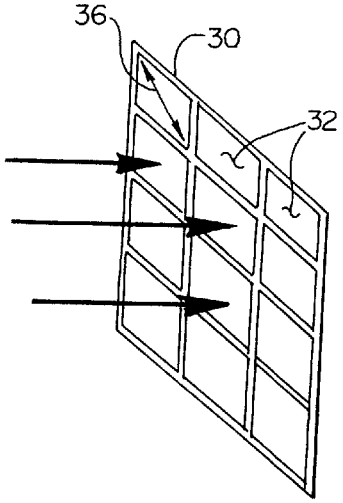
FIG. 3 is a simplified perspective view of a conducting sheet with apertures useful in the practice of the present invention.
Figure 4:
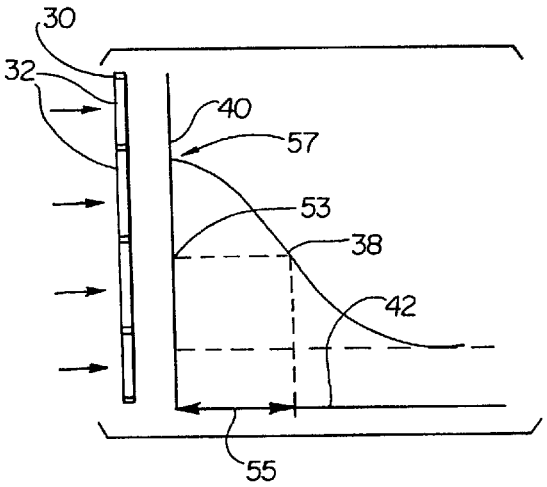
FIG. 4 is a side view of the perforated conducting sheet of FIG. 3, along with a simplified graph of evanescent microwave propagation power decay after microwave energy transits the sheet.

Unlike conventional packages for microwave popcorn, the package 20 of the present invention further includes a layer 30 that is effective to provide at least partial microwave shielding. Layer 30 may be formed of metal. Referring now also to FIGS. 3 and 4, the microwave shielding layer 30 has a plurality of apertures 32 therein, with each aperture sized to permit a controlled amount of both conventional propagating microwave energy and evanescent or non-propagating microwave energy to enter the package. In the preferred embodiment, layer 30 is desirably thick enough to prevent the transmission of microwave energy therethrough [and is desirably thick enough, i.e., a thickness greater than the penetration depth, to avoid layer 30 functioning (generally) as a susceptor]. It is believed that conventional susceptors are in the range of tens to hundreds of Angstroms in thickness. For conventional metals such as copper and aluminum (not acting as susceptors, but instead providing microwave shielding) the penetration depth is about a few microns.

The shape and size and pattern or lattice of the apertures are preferably chosen to limit transmission of microwave energy to control the entry of both propagating and evanescent microwave energy when the microwaves transit the layer 30. This is achieved primarily by maintaining the maximum dimension 36 of each aperture 32 to be sufficiently small to limit the transmission of propagating modes of microwave energy through layer 30 to desired levels. In comparison, and as a figure of merit, for a long waveguide with square cross section, the microwave energy is limited to an evanescent mode when:

$$i\ a<\lambda/2 \tag{1}$$

where "a" is the linear dimension of the waveguide cross section, and $\lambda$ is the free space wavelength.

In general in the prior art relating to waveguides and the like, "evanescent mode" has been used to refer to operation below cutoff, i.e., $\lambda>\lambda_c$, where $\lambda_c$ is the cutoff wavelength, and the guide wavelength $\lambda_g$ is given by Equation (2):

$$\lambda_g=\lambda/(1-v^2)^{1/2} \tag{2}$$

where v is the normalized wavelength, given by Equation (3) as the ratio of the wavelength of interest, $\lambda$, to the cutoff wavelength:

$$v=\lambda/\lambda_c \tag{3}$$

The free space wavelength is about 12.24 cm for 2450 MHz.

As used herein, the term "evanescent" is believed to be consistent with, but an extension of, the use of that term in the prior art. Typically, in a microwave oven, the cavity is "overmoded," unlike conventional waveguide operation. Since the food package of the present invention is exposed to the overmoded field in order to carry out the present invention, the term "evanescent" here is used by analogy or extension to prior art use and refers to decaying, as opposed to propagating microwave energy passing through the grid or aperture pattern of the microwave shielding layer 30.

Returning again to conventional prior art systems, such as waveguides below cutoff, the microwave energy decays generally exponentially with a depth of penetration 49 given by Equation (4):

$$D_p=(a/2\pi)[1-(2a/\lambda)^2]^{-1/2} \quad (4)$$

As is illustrated generally in FIG. 4, the microwave power transiting sheet or layer 30 having apertures 32 therein is limited to being evanescent or non-propagating when the maximum dimension of the apertures 32 is below a length permitting propagating power to pass through such apertures. For square or rectangular apertures, the maximum dimension is a diagonal 36. For apertures of other geometries, the maximum dimension is characteristically the longest "free" dimension of the aperture, e.g., for an ellipse, the chord through the two vertices (along the major axis) is the maximum dimension. Curve 38 is an illustration of the power decay of evanescent microwave energy plotted with energy on the ordinate axis 40 and distance from the layer 30 along the abscissa 42. It is to be generally understood, that the smaller the maximum dimension of the apertures, the more rapid the power decay, provided that other design parameters are held constant. The evanescent mode of microwave energy transiting the apertured layer 30 will form a spatially limited zone of microwave energy beyond the outer surface of layer 30. The depth of the zone beyond the layer 30 can be adjusted by varying the dimensions (especially the maximum dimension) of the apertures in the layer, or by adjusting the shape or pattern of the apertures. In the practice of the present invention, apertures 32 in layer 30 create a spatially controlled "penetration zone" 44 (see FIGS. 5 and 6) for microwave heating within package 20.

In FIG. 5 it will be noted that when the package or bag 20 is collapsed in its initial configuration, the evanescent penetration zone may extend substantially across the entire interior of the package, thus permitting substantial microwave irradiation both from above and below, in effect providing an "overlap" of the evanescent penetration zone extending down from the top layer with the evanescent penetration zone extending up from the bottom layer. In the alternative, the upper and lower evanescent penetration zones may abut each other, or it may be desirable (for other reasons) to have the evanescent penetration zones not overlap, e.g., in the event the food load is desirably or necessarily thicker than the sum of the depths or thicknesses the desired evanescent penetration zones.

In FIG. 6, with the bag expanded or inflated, the evanescent penetration zone 44 extends only a predetermined, limited distance within layer 30, with the boundary of the evanescent penetration zone 44 indicated by dashed line 46. In the idealized images shown in FIGS. 5 and 6, it is to be understood that apertures 32 extend across substantially all of the surface of layer 30 of package 20, and a controlled amount of propagating energy may be admitted, as desired, to the interior of the bag, in a manner described infra.

Figure 11:
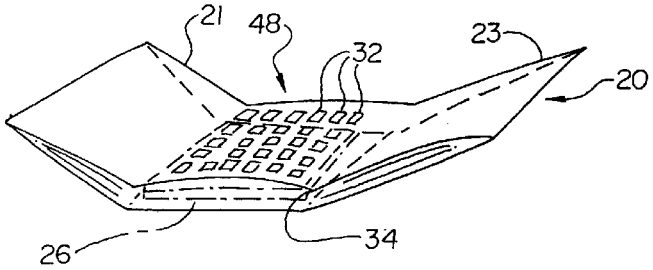
FIG. 11 is a view similar to FIG. 1, except that the popcorn bag is generally enclosed by a microwave shielding layer with apertures only in a limited region thereof and with the unpopped popcorn load omitted for clarity.
Figure 12:
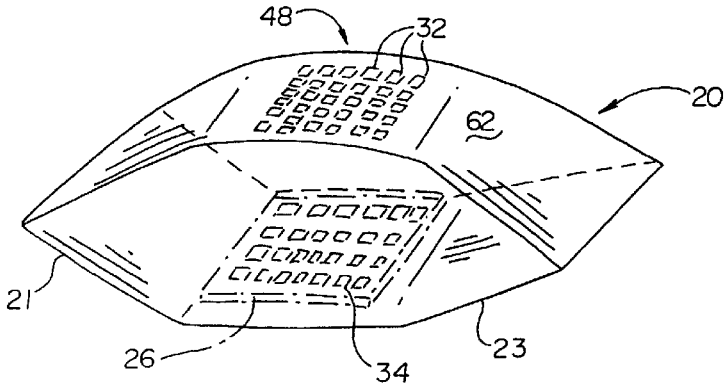
FIG. 12 is a view according to FIG. 1, except showing the popcorn bag in the second state and with the popped popcorn load omitted for clarity.

While the pattern of apertures 32 may extend across the entire package (as is illustrated in an alternative embodiment in FIGS. 8 and 9), alternatively, the microwave shielding layer 30 may extend across substantially all of the surface 62 of the food package 20, with one or more patterns of apertures 32 extending across only one or more predetermined, limited regions, for example, a region made up of sub-regions 34, 48 of the food package 20, as is shown in FIGS. 11 and 12. In FIG. 12, sub region 48 is located on surface 62 of shielding layer 30, while sub-region 34 is located on a lower surface of shielding layer 30 adjacent susceptor 26. As a still further embodiment, various regions may have different sized or shaped or spaced apertures to selectively control either the evanescent microwave energy or both the evanescent and propagating microwave energy passing through layer 30 and into the interior of package 20. To that end, it has been found that altering not only the dimensions of the apertures themselves, but also (or in addition) altering the spacing between apertures can be used for such microwave energy control. In particular, using a varying spacing between apertures can be made to be less restrictive to the passage of microwave energy through the apertured layer 30. As used herein, it is to be understood that "lattice" refers to the geometrical arrangement of apertures, particularly the spacing between adjacent rows or columns (or both) of the apertures 32 in layer 30. It is believed that various forms of lattice variation schemes, such as monotonically varying, periodically varying and even random (or pseudo-random) varying lattice arrangements are of use in the practice of the present invention.

Figure 14:
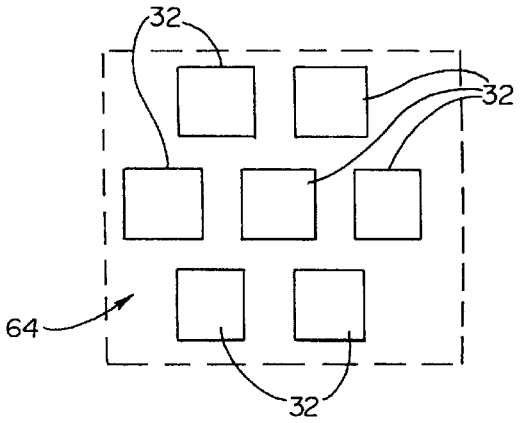
FIG. 14 is a plan view of an alternative lattice arrangement for an aperture pattern useful in the practice of the present invention.

It is to be understood that it is within the scope of the present invention to use offset lattices in the practice of the present invention. Such offset lattices can be periodic or non-periodic, and different regions of the microwave shielding layer can have different lattice arrangements in addition, or as an alternative, to changing the shape and size of individual apertures. In FIG. 14, a triangular lattice 64 is formed by the pattern of individual apertures 32, and is illustrative of an alternative to the regular square lattice or pattern of apertures shown with respect to the earlier Figures. It is also within the scope of the present invention to use other aperture shapes in such alternative lattice arrangements, as well.

Figure 13:
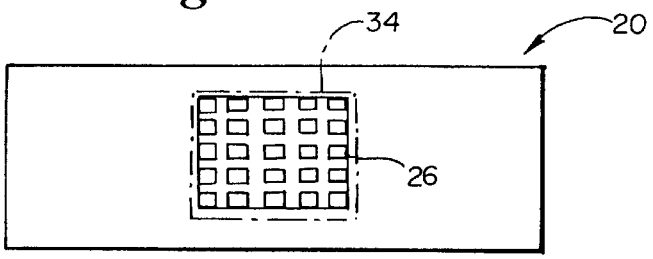
FIG. 13 is a bottom plan view of the bag of FIG. 12 in the second state.

Turning now to the embodiment shown in FIGS. 11, 12 and 13 (which correspond to the embodiment of FIGS. 1 and 2), the evanescent and propagating microwave energy penetrates layer 30 in an upper surface initially only in a region 48 corresponding to the food load 22. It is to be understood that the propagating energy will ordinarily extend further into the package 20 than will the evanescent energy, since the evanescent energy will be limited to the evanescent penetration zone as previously described. The propagating energy, while typically attenuated, will generally progress throughout the interior of the package, until absorbed by the food load.

At the same time, microwave energy is continuously applied through region 34 of a lower surface to heat the food load 22. It is to be further understood that the microwave energy entering through region 34 may be limited to evanescent, or may be a combination of evanescent and propagating energy, as may be the energy entering through region 48.

In this embodiment, package 20 thus includes a predetermined region containing the plurality of apertures that includes both isolated or non-contiguous sub-regions 48 and 34 on one or more than one surface of the food package or bag 20. Initially, in this embodiment, the predetermined region is preferably generally congruent to the food load 24 as it exists prior to being heated. As the food load 24 is heated, the bag 20 inflates due to the steam or water vapor generated by microwave heating of the food load, such as, but not limited to popcorn popping, moving region 48 away from the food load 22, thus limiting penetration of evanescent microwave energy through apertures 32 to the evanescent penetration zone adjacent the interior of region 48, while at the same time restricting or attenuating propagating microwave energy entering through region 48. In this embodiment, the food load such as, but not limited to the bulk of the popped popcorn, will be shielded by layer 30 from further exposure to evanescent microwave energy entering through region 48, while the food load 22 adjacent region 34 will be continuously exposed (through sub-region 34) to the microwave energy entering therethrough to complete heating (e.g., popping, in the case of microwave popcorn). Furthermore, gravity will move the popped kernels away from the sub-region 48, even though continued popping will jostle the popped kernels. Referring now again to FIG. 6, the depth 49 of the evanescent penetration zone 44 can be controlled and varied from place to place along the bag or package 20 (or 50) by using different sizes or shapes or numbers or spacing of apertures 32 in different sub-regions of layer 30 around the bag 20. For example, and not by way of limitation, the evanescent penetration zone 44 can have a depth of penetration or thickness of ¼ inch adjacent sub-regions 48 and 34, and a lesser depth of penetration 51 of ⅛ inch in the remainder of the interior of the food package 20. Referring now again to FIG. 4, the example numerical values for the depths of penetration 49, 51 are relative figures of merit, for example, and not by way of limitation, the half-power points corresponding to distance 55 away from ordinate axis 40 (representing the outer surface of layer 30) where level 53 is one half the peak power 57 of curve 38.

Figure 2:
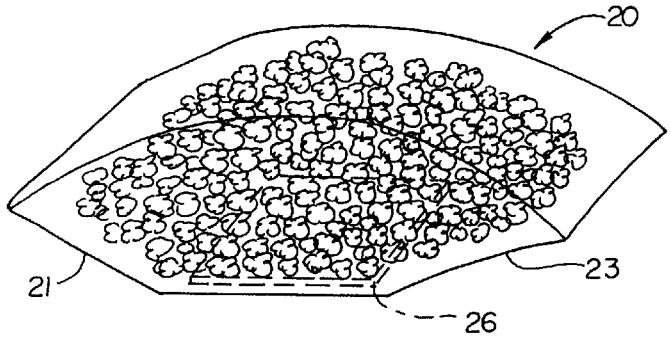
FIG. 2 is the popcorn bag of FIG. 1 shown in a second state with a substantial amount of popcorn popped.
Figure 15:
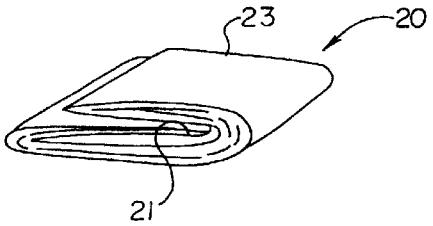
FIG. 15 is a perspective view of the popcorn bag of the embodiment of FIG. 1 shown in an a completely folded state.
Figure 16:
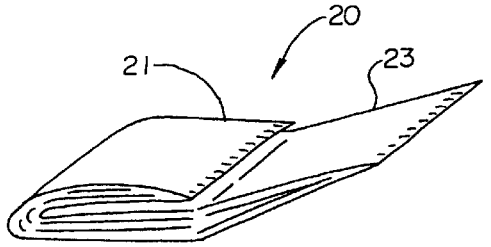
FIG. 16 is a perspective view of the popcorn bag of FIG. 15 shown in a partially unfolded state.

Referring now most particularly to FIGS. 15 and 16, the embodiment of FIGS. 1 and 2 is shown in fully folded and partially folded configurations. FIG. 15 shows bag or package 20 with first and second wings 21, 23 in a fully folded configuration. FIG. 16 shows bag 20 in a partially folded configuration with wing 21 folded and wing 23 unfolded. It is to be understood that bag 20 is preferably fully folded when packed for shipment and sale. In the practice of the present invention, bag 20 may be placed in a microwave oven fully or partially folded, or fully unfolded (as illustrated in FIGS. 1 and 11) prior to exposure to microwave irradiation. However, it is preferred that the bag 20 be fully unfolded as shown in FIG. 1 prior to microwave irradiation. As with conventional bags, if a susceptor 26 is used, bag 20 is preferably oriented with the surface containing the susceptor located on the bottom.

The present invention, in the embodiments shown, provides a bag for reducing scorching while still enabling popping of popcorn, or popping, puffing, or otherwise heating other foodstuffs, by allowing significant penetration of microwave energy into the bag, delivering sufficient energy to pop the popcorn while the bag is in a collapsed or folded condition. After popping has inflated the bag, the majority of the food package interior (i.e., the region beyond, or interior of, the penetration zone) is protected from further entry of significant evanescent microwave energy, while still permitting entry of propagating energy. Thus at least a portion of the foodstuff has the microwave shielding layer moved away from close proximity thereto after the package and the foodstuff (in this case, popcorn) is irradiated with at least a predetermined amount of microwave energy. This is accomplished by selecting one or more sizes of apertures 32 to permit passage of a predetermined amount of evanescent (i.e., non-propagating) microwave energy modes into the interior of the bag, while at the same time, sizing the apertures to permit a controlled amount of propagating energy into the bag. In the practice of the present invention wherein the susceptor 26 is interior of layer 30, there is preferably a region 34 in layer 30 on the bottom surface of the package 20 at least substantially congruent to the susceptor 26 to permit microwave energy to reach and heat the susceptor 26 as the energy enters from the bottom of the package. If susceptor 26 is located exterior of layer 30, it may still be preferable to have a grid or perforated region 34 on the bottom of the package to enable microwave energy to pass through susceptor 26 and heat the food load located inside the package. In either event, the lattice or grid of region 34 is desirably arranged to permit evanescent mode energy and a predetermined amount of propagating mode microwave energy into the interior of package 20. This may be accomplished by providing a pattern of apertures 32 adjacent to the susceptor 26. It is to be understood that the susceptor 26 may be located interior or exterior of the microwave shielding layer 30, (or even may be omitted) as desired.

Figure 7:
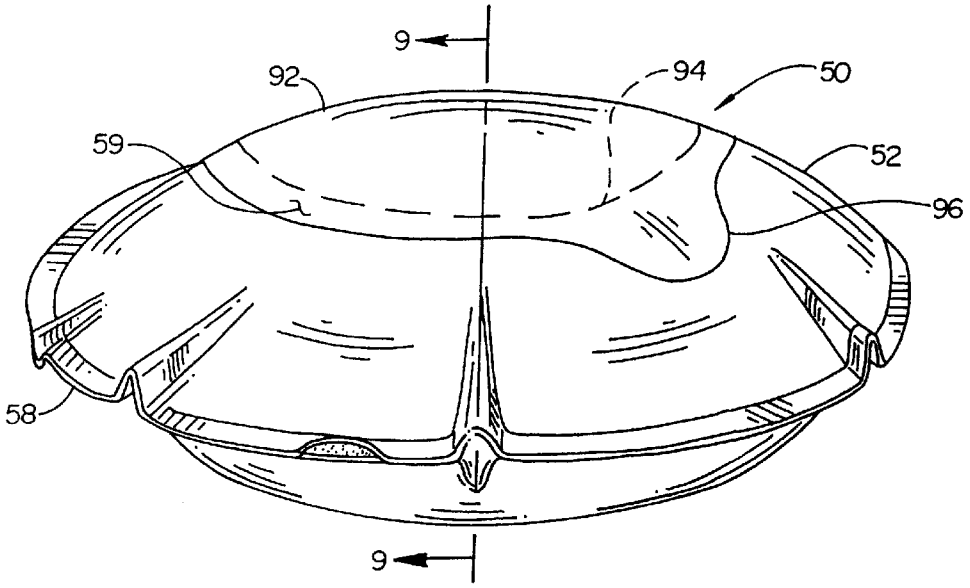
FIG. 7 is a perspective view of an alternative embodiment of a package useful in the practice of the present invention and shown in an expanded condition.

Referring now to FIGS. 7 through 10, an alternative embodiment of the present invention may be seen. In FIG. 7, the package 50 of this embodiment is shown in an expanded condition. The package or bag 50 is generally circular in plan as may be seen most clearly in FIG. 8. As with the previously described embodiment, bag 50 is preferably formed of a flexible, but non-extendable material such as paper or similar cellulose material 52, with a microwave shielding or reflective layer 54 laminated thereto. The various panels or walls making up bag 50 are preferably sealed to trap the water vapor created within the bag 50 during microwave heating thereof, while at the same time allowing selective rupture when desired to permit access to the interior of the bag when the food is to be consumed. It is preferred to provide an annular adhesive strip 56 to secure the walls of bag 50 together, using heat and or pressure.

Figure 8:
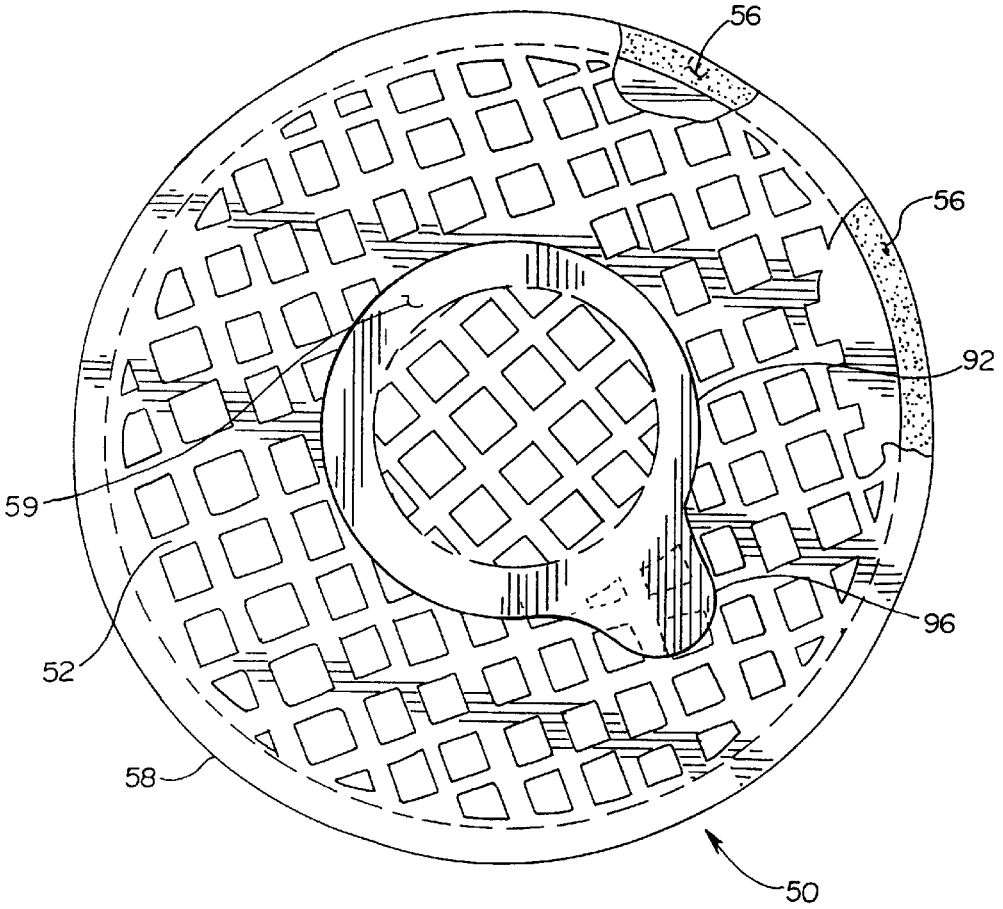
FIG. 8 is a top plan view of the package of FIG. 7 illustrating a microwave shielding layer with apertures therein in an unfilled, flat condition, with portions broken away.
Figure 9:
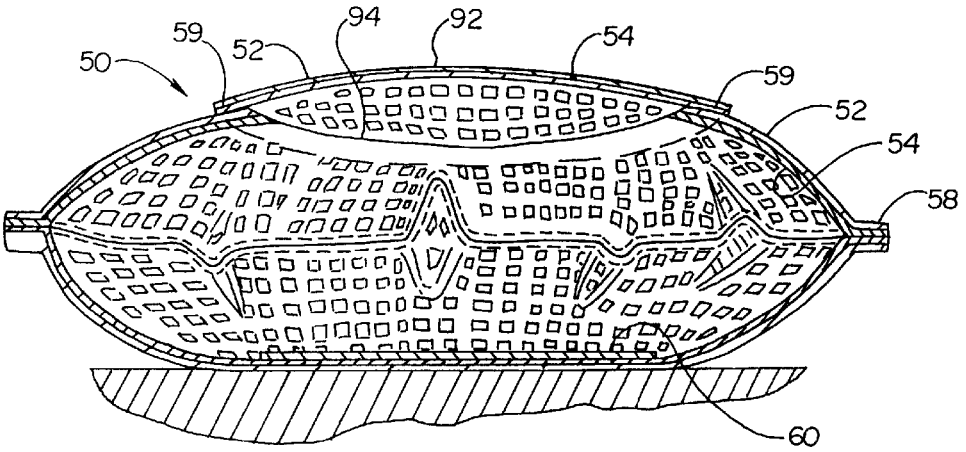
FIG. 9 shows a cross sectional view of the package of FIG. 7 according to section line 9—9 of FIG. 7, with the popped popcorn removed and the microwave shielding layer with apertures therein shown for illustration.

It is to be understood that it is preferable to form bag 50 as a generally planar assembly when collapsed. FIGS. 8 and 9 illustrate that the microwave shielding layer 54 is perforated with apertures 32 across substantially all of the surface thereof, with the possible exception of the adhesively secured seams 58 and 59. As in the first embodiment, it is to be understood that the microwave shielding layer may be invisible to a consumer user, being laminated between other layers forming a sanitary or septic food package. In FIG. 9 a susceptor 60 is shown, preferably secured to bag 50. As with the first embodiment, susceptor 60 can be exposed to the full effect of microwave irradiation by being located exterior of the microwave shielding layer 54, or it may be attached interior of the apertured microwave shielding layer 54. Bag 50 is preferably loaded with a charge of unpopped popcorn, and fat or oil, with flavorings and colorants optionally included. Bag 50 is preferably folded into a generally rectangular configuration for shipping and vending, and, in its folded configuration, may be of a size and shape similar to the first embodiment or other conventional microwave oven ready popcorn packages.

Figure 10:
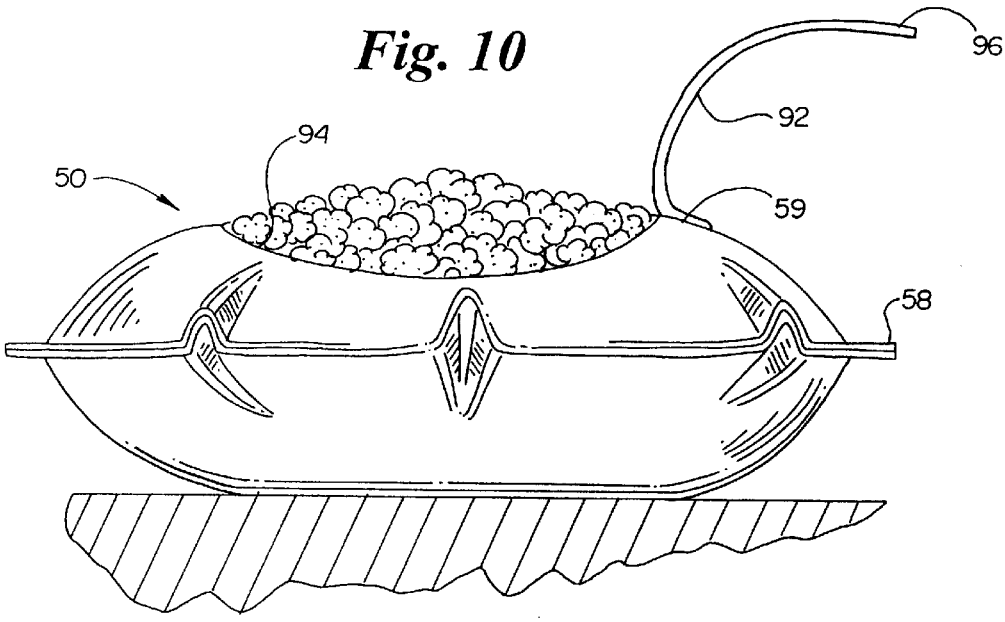
FIG. 10 shows a side view of the package of FIG. 7 in an opened condition.

Bag 50 also preferably has a removable cover 92 overlapping an opening 94 in the upper surface thereof. Cover 92 preferably has an adhesive seam 59 which is openable by a consumer once the popcorn is popped, as is illustrated in FIG. 10. A non-adhered flap 96 preferably is formed integrally with cover 92 to assist in opening the bag 50. It is to be understood that cover 92 may have an aesthetically pleasing outer layer 52 formed, for example of a heat stable polymer or paper and an inner microwave shielding layer 54, with apertures therein, as is illustrated in FIGS. 8 and 9.

It is to be understood that the contents of the food package of the present invention may be popcorn kernels or any suitable grain such as rice, maize, barley, sorghum, or the like for being popped or puffed when heated or reheated in a microwave oven.

When subjected to microwave heating, the susceptor will convert microwave energy to heat, and the food load will be subjected to direct heating until sufficient water vapor is released to expand the bag sufficiently to move the upper apertured microwave layer away from the food load by a distance greater than the depth of penetration of the evanescent microwave energy. As popping or puffing continues, the food package will inflate or expand further, enlarging the volume protected from substantial evanescent microwave irradiation interior of the evanescent penetration zone. It is to be understood that the evanescent penetration zone may extend substantially across the entire interior surface of package 50. While propagating microwave modes may be desirably admitted to the interior of the food package, the protected volume interior of the evanescent penetration zone will reduce the chance of overheating or burning the load (e.g., scorching if the load is popcorn). Fortunately, however, for popcorn loads the jostling of the popped popcorn will constantly move peripheral popped kernels into and out of the evanescent penetration zone, also reducing the chance of scorching. Static loads will not have the jostling movement, however, and the ability to protect the volume interior of the evanescent zone from excessive microwave irradiation using the present invention provides a useful and important design tool in the practice of the present invention.

The grid pattern for square apertures in the practice of the present invention is preferably in the range of ½ to 2 inches in linear dimension (the length of each side of an aperture). In order to create evanescent microwave energy interior of the microwave shielding layer, the thickness and width of the grid pattern forming the apertures must be greater than the penetration depth δ of the conducting material. For a material of conductivity σ, the penetration depth is given by Equation (6):

$$\delta=c/(2\pi\sigma\omega)^{1/2} \tag{6}$$

where c is the speed of light, and ω is the microwave (radian) frequency.

The width of the grid is desirably greater than the penetration depth (a few microns, depending on material) and less than about ½ inch. It is to be emphasized that the shape of the apertures can be regular or irregular, and can include, but is not limited to square, triangular, round, elliptic and even irregular or amorphous (if limited in its maximum dimension to achieve the evanescent microwave mode). The grid or aperture pattern can be regular across the surface of the package or it can be interrupted or irregular, as desired to achieve the proper heating effect for the particular food load carried by the package. The microwave shielding layer can be formed of any material capable of reflecting microwave energy, including, but not limited to, most metals and alloys, such as aluminum, nickel, copper, silver, iron, stainless steel, and the like.

Referring now to FIGS. 17 through 21, the relative microwave transmission through a grid formed of apertures may be seen. The graphs of these figures were arrived at through modeling of a propagating microwave field with normal (i.e., perpendicular) incidence to the plane of the sheet of a metal grid containing the apertures. The microwave field was modeled using a wavelength of 12.3 cm. The modeling was performed according to the teachings of C. C. Chen, *IEEE Transactions on Microwave Theory and Techniques*, January, 1973, pages 1–6. In the graphs of these figures, the transmission coefficient T 66 is the averaged intensity just behind an opening as a fraction of the incident intensity. It is a measure of the microwave energy transmitted through the sheet or plane of the grid. (7)

Figure 17:
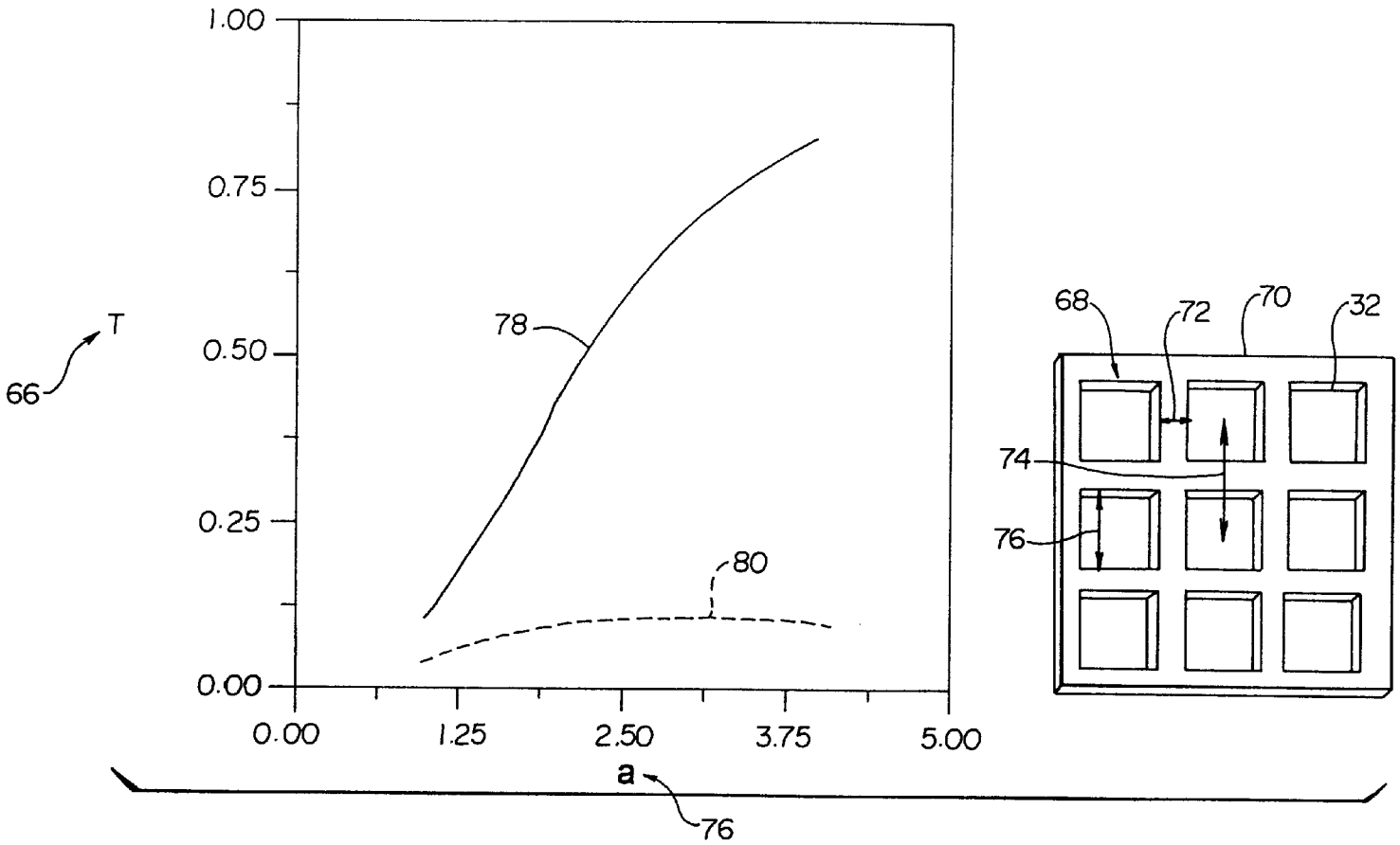
FIG. 17 is a graph of the transmitted propagating and evanescent mode microwave intensity plotted against aperture size for a first bridge width and showing an example metal sheet with apertures forming a rectangular lattice grid.

The microwave field distribution after passing through a metal grid is given by Equation (7):

$$E_{Transmission}=TE_0e^{jkz}+\Sigma A_{n_xn_y}\cos(2\pi n_x x/L_x)\cos(2\pi n_y y/L_y)e^{-z/2\Delta n_xn_y} \tag{7}$$

where the summation is from $n_x,n_y=0$, not both zero to ∞, and x and y are respectively orthogonal directions, here horizontal and vertical with respect to the sheet 70 of FIG. 17, where "a" represents the aperture width 76 and L represents the center to center distance 74 between adjacent apertures 32, and w represents the bridge width 72; thus: $L_x=a_x+w$ and $L_y=a_y+w$, in the horizontal and vertical directions, respectively. It is to be understood that "vertical" and "horizontal" as used here are intended solely as an aid in viewing and interpreting the sheet 70 of FIG. 17 with respect to the Equations (7)–(9) and are not intended to be otherwise limiting, since the plane of the sheet 70 may be oriented otherwise than vertical as is depicted in FIG. 17, and in fact, the sheet may not form a plane, but instead be a curved or irregular surface in practice.

For Equation (7), T is the transmission coefficient of propagating wave. $E_0$ and k are the electric field and wave-number of the incident microwave, respectively. $A_{n_xn_y}$ and $\Delta_{n_xn_y}$ are the coefficient and penetration zone depth of the $(n_x,n_y)$ evanescent mode, respectively, The penetration zone depth for individual evanescent modes is given by Equation (8):

$$\Delta n_xn_y=½[(2\pi n_x/L_x)^2+(2\pi n_y/L_y)^2-(2\pi/\lambda)^2]^{-½} \tag{8}$$

where λ is the wavelength of the microwave energy in free space. Equation (8) gives the penetration zone depth of the various evanescent modes.

If $L_x$22 $L_y$, then the maximum penetration zone depth is given by Equation (9):

$$\Delta\max=\Delta_{1,0}=(L_x/4\pi)[1-(L_x/\lambda)^2]^{-½}\approx L_x/4\pi,\ \text{for } L_x<<\lambda \tag{9}$$

For Lx=Ly=1.5"≈3.8 cm, the Penetration Zone depth for respective individual modes is given by Table 1:

TABLE 1

| $n_x$ | $n_y$ | $\Delta n_xn_y$ (in mm) |
|---|---|---|
| 1 | 0 | 3.18 |
| 1 | 1 | 2.19 |
| 2 | 0 | 1.53 |
| 2 | 1 | 1.37 |
| 2 | 2 | 1.08 |
| 3 | 0 | 1.01 |
| 3 | 1 | 0.96 |
| 3 | 2 | 0.84 |
| evanescent mode indices | | penetration zone depth |

It is to be understood that the formulae and table values are for free space behind the grid. If other media are present, that will change the formulae and table values.

The primary parameters for controlling propagating and evanescent microwave energy transmission through a metal grid are the thickness of the metal forming the grid, and the size, shape and arrangement pattern of the apertures forming the grid.

The thickness of the metal controls the shielding quality of the metal. In general, it is preferred to have the thickness of the metal be greater than the skin depth of microwave penetration to provide good shielding properties. The skin depth of a typical metal such as aluminum is in the range of 1~2 microns. In the practice of the present invention, it is generally preferred that the metal function as a good shield to microwave passage. For this reason, the preferred metal thickness is something greater than the skin depth. Of course, other considerations, such as manufacturability and durability of the metal layer will also be significant, and may dictate a thickness greatly in excess of what is needed for microwave shielding purposes.

Aperture size is considered one of the most important parameters for controlling microwave energy in the practice of the present invention. In FIGS. 17–21 the relative microwave field intensity T 66 is plotted on the ordinate (vertical axis) against aperture size "a" 76 plotted (in centimeters) on the abscissa (horizontal axis) for various bridge widths for the model metal grid shown in sheet 70 in FIG. 17. In each of FIGS. 17–21, it is to be understood that the apertures 32 are square shaped and the aperture arrangement pattern or lattice or grid pattern 68 is also square, all as shown in the grid 68 of FIG. 17. Each of FIGS. 17–21 shows the calculated transmitted (propagating) wave intensity on curve 78 and evanescent wave intensity on curve 80 as a function of aperture size (related to the aperture width a 76 and the maximum dimension h 36), with the center to center distance 74 between apertures 32 held fixed over the data in a particular Figure. For very small aperture sizes, i.e., with the characteristic dimension a <1 cm, very little microwave energy penetrates through the grid. Both propagating and evanescent modes have low intensity. As the aperture size increases, initially both propagating and evanescent field intensities increase. However, beyond a certain aperture size, evanescent energy begins to decrease with aperture size. Using FIGS. 17–21, it is possible to select an aperture size to maximize evanescent mode energy in relation to the propagating mode microwave energy.

Figure 18:
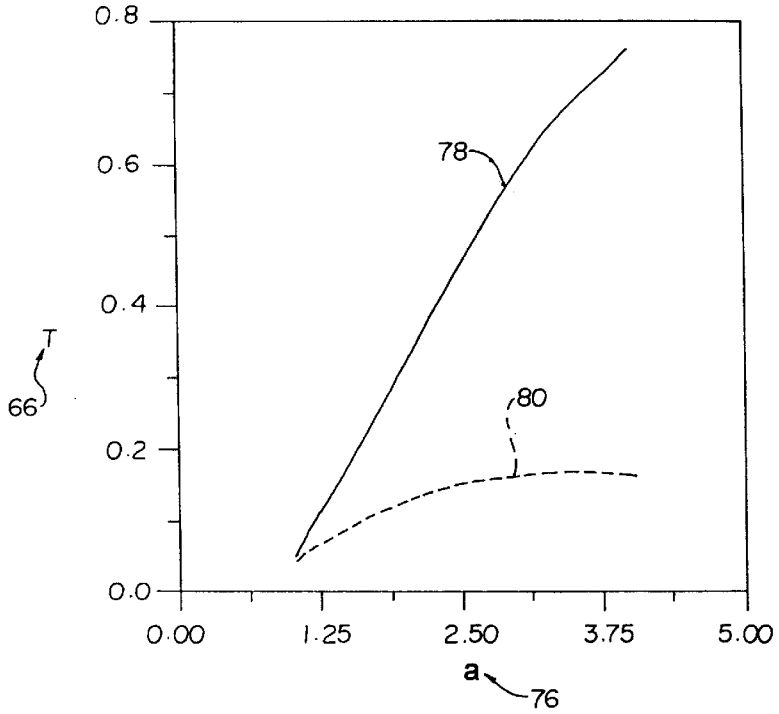
FIG. 18 is a graph of the transmitted propagating and evanescent mode microwave intensity plotted against aperture size for a second bridge width
Figure 19:
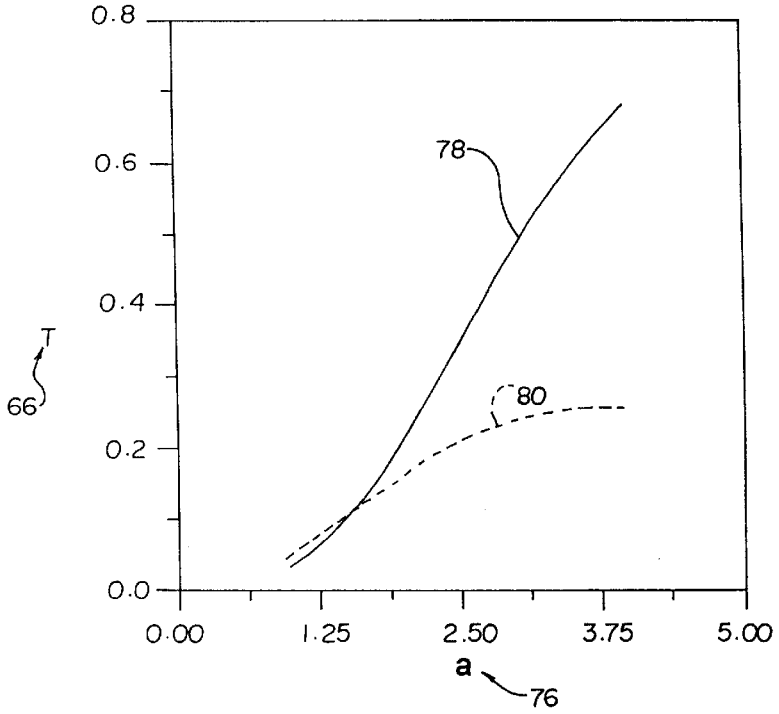
FIG. 19 is a graph of the transmitted propagating and evanescent mode microwave intensity plotted against aperture size for a third bridge width
Figure 20:
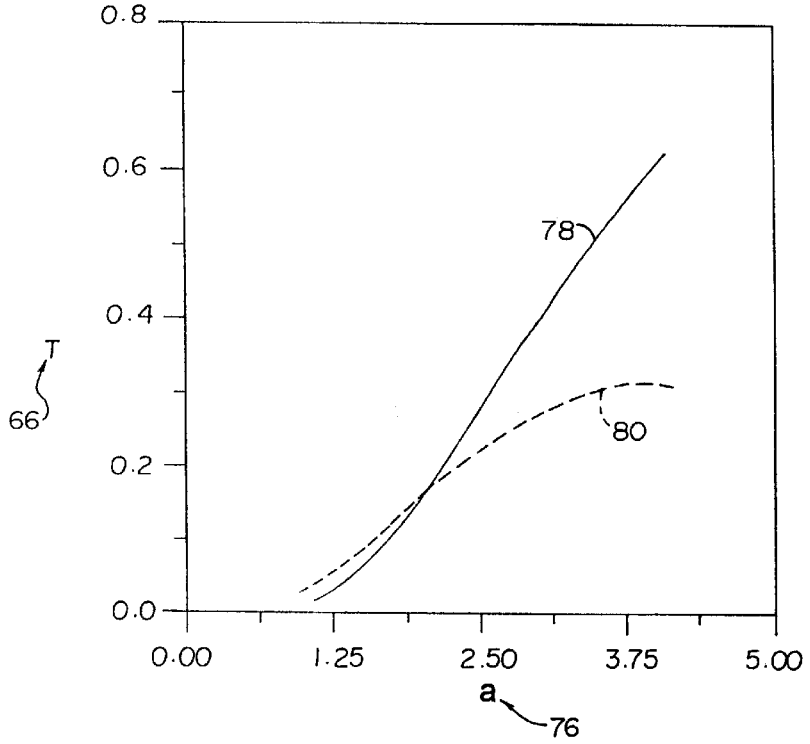
FIG. 20 is a graph of the transmitted propagating and evanescent mode microwave intensity plotted against aperture size for a fourth bridge width
Figure 21:
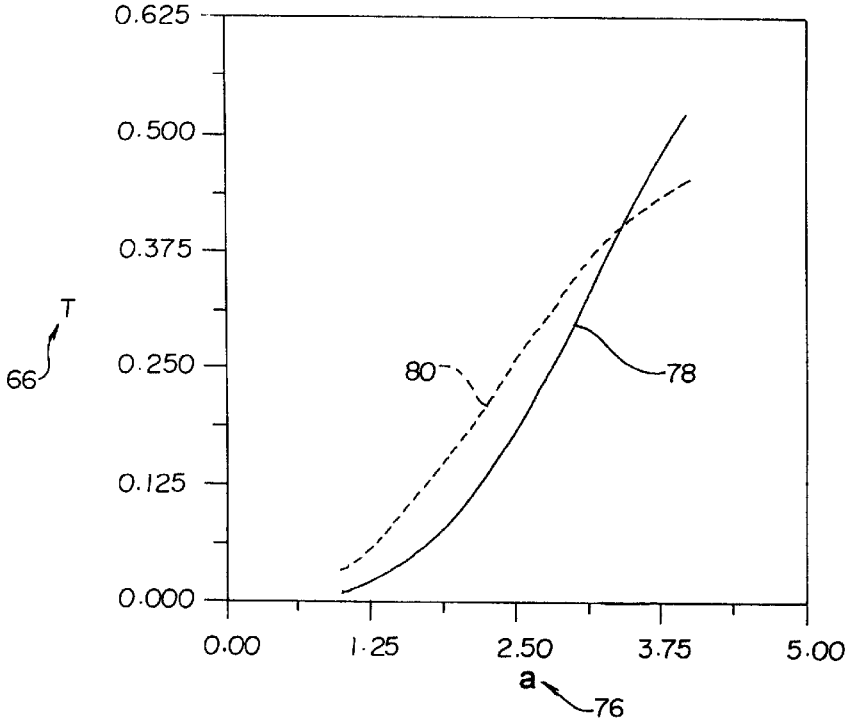
FIG. 21 is a graph of the transmitted propagating and evanescent mode microwave intensity plotted against aperture size for a fifth bridge width

FIG. 17 is for a bridge width w 72 of 0.1 cm. FIG. 18 is for a bridge width w 72 of 0.2 cm. FIG. 18 is for a bridge width w 72 of 0.2 cm. FIG. 19 is for a bridge width w 72 of 0.35 cm. FIG. 20 is for a bridge width w 72 of 0.5 cm. FIG. 21 is for a bridge width w 72 of 0.8 cm.

Figure 22:
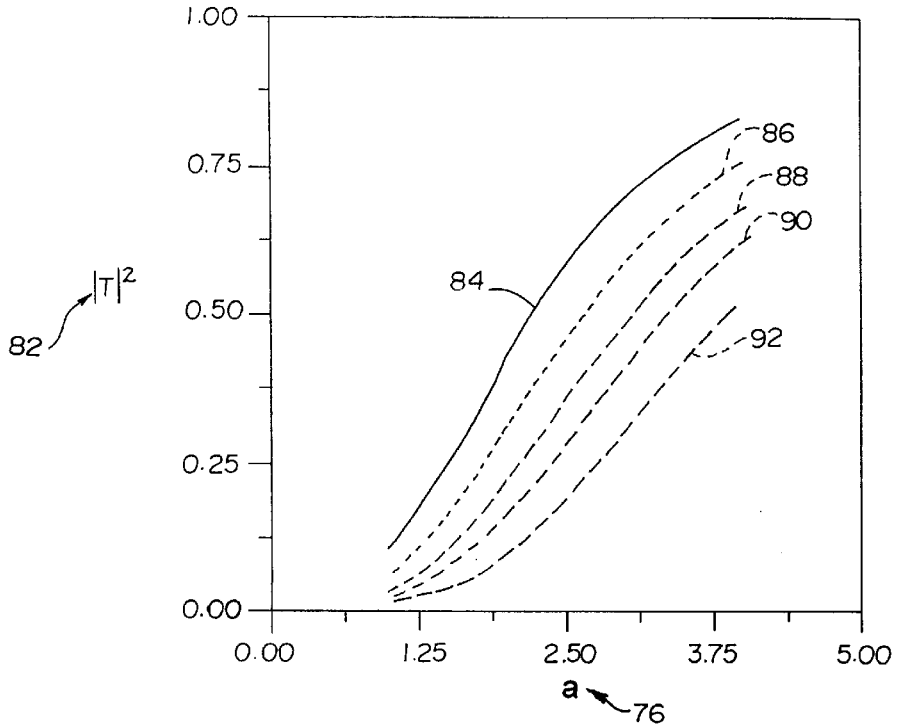
FIG. 22 is a graph of the average microwave transmission coefficient plotted against aperture size with bridge width shown as a parameter.

Referring now to FIG. 22, the square of the absolute value 82 of the transmission coefficient 66 is shown plotted against aperture width "a" 76 for various bridge widths. Curve 84 is for a bridge width of 0.1 cm. Curve 86 is for a bridge width of 0.2 cm. Curve 88 is for a bridge width of 0.35 cm. Curve 90 is for a bridge width of 0.5 cm. Curve 92 is for a bridge width of 0.8 cm. The effect of varying the bridge width on the square of the absolute value of the transmission coefficient is shown as a parameter, illustrating that average transmission of the propagating mode increases with decreasing bridge width, for any given aperture size in the range illustrated.

Figure 23:
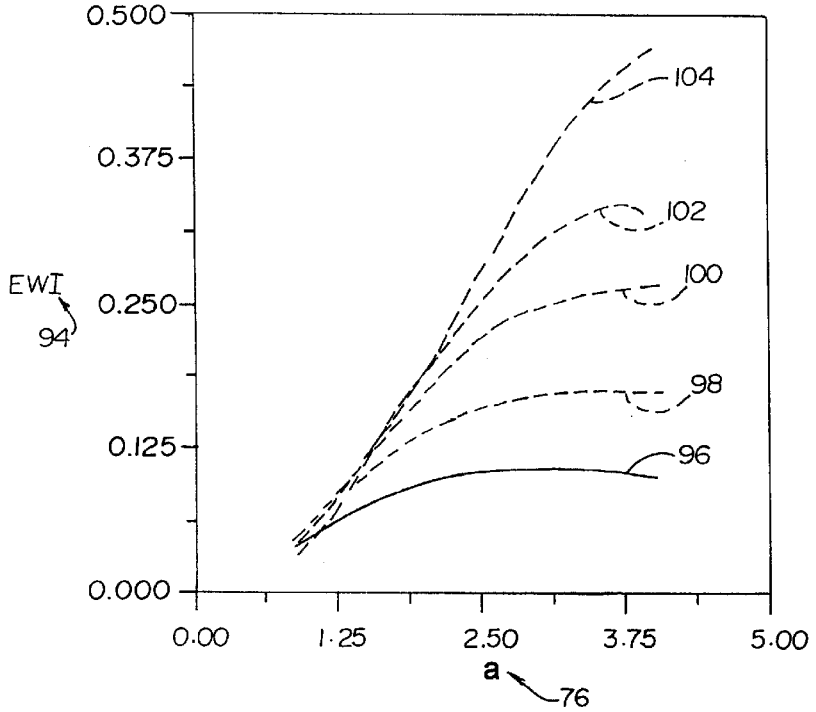
FIG. 23 is graph of evanescent mode microwave energy plotted against aperture size with bridge width shown as a parameter.

Referring now to FIG. 23, the evanescent wave (mode) intensity EWI 94 in free space immediately behind or downstream of the grid is plotted against aperture width "a" 76 for various bridge widths. Curve 96 is for a bridge width of 0.1 cm. Curve 98 is for a bridge width of 0.2 cm. Curve 100 is for a bridge width of 0.35 cm. Curve 102 is for a bridge width of 0.5 cm. Curve 104 is for a bridge width of 0.8 cm. As may be seen, increasing bridge width w 72 while holding everything else constant will result in an increase in evanescent energy passing through the grid 68. These curves may be used to help design the evanescent energy component desired to be delivered through the package to the load.

Figure 24:
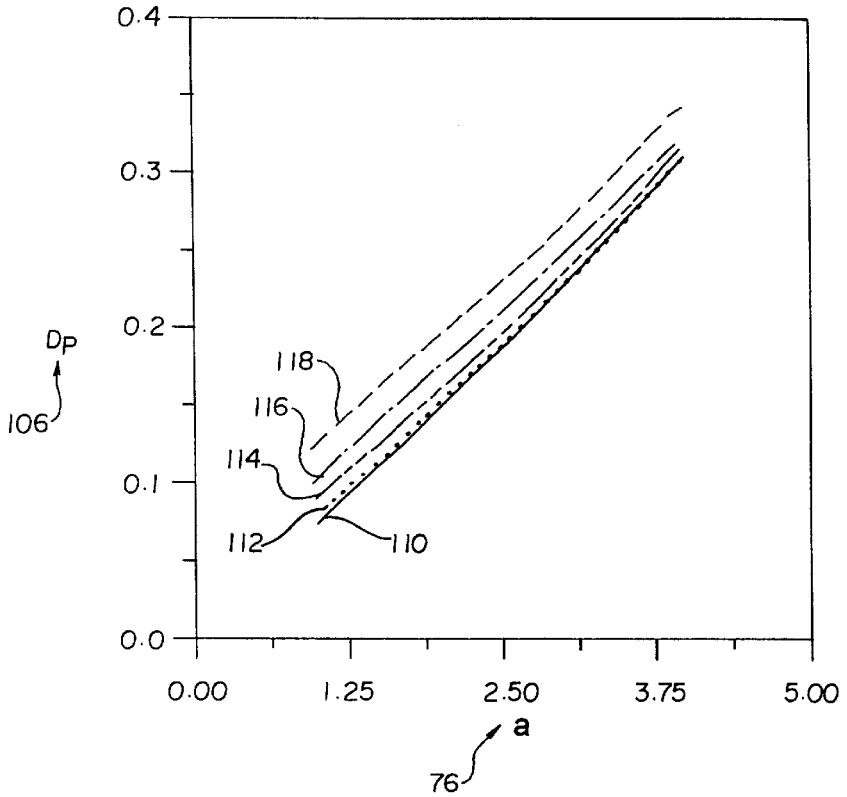
FIG. 24 is a graph of the penetration depth of evanescent mode microwave energy plotted against aperture size with bridge width shown as a parameter.

Referring now to FIG. 24, the penetration zone depth of the combined evanescent modes, $D_z$ 106, is plotted against aperture width "a" 76 for various bridge widths. Curve 110 is for a bridge width of 0.1 cm. Curve 112 is for a bridge width of 0.2 cm. Curve 114 is for a bridge width of 0.35 cm. Curve 116 is for a bridge width of 0.5 cm. Curve 118 is for a bridge width of 0.8 cm. As may be seen, increasing bridge width w 72 while holding everything else constant will result in an increase in penetration zone depth 106 of the evanescent energy passing through the grid 68. It is to be understood that the penetration zone depth $D_z$ differs from the penetration depth $D_p$ in that $D_z$ is for all evanescent modes behind (downstream of) the grid, in contrast to $D_p$ which is typically used in the context of only a single evanescent or cut off mode in an infinitely long waveguide.

Figure 25:
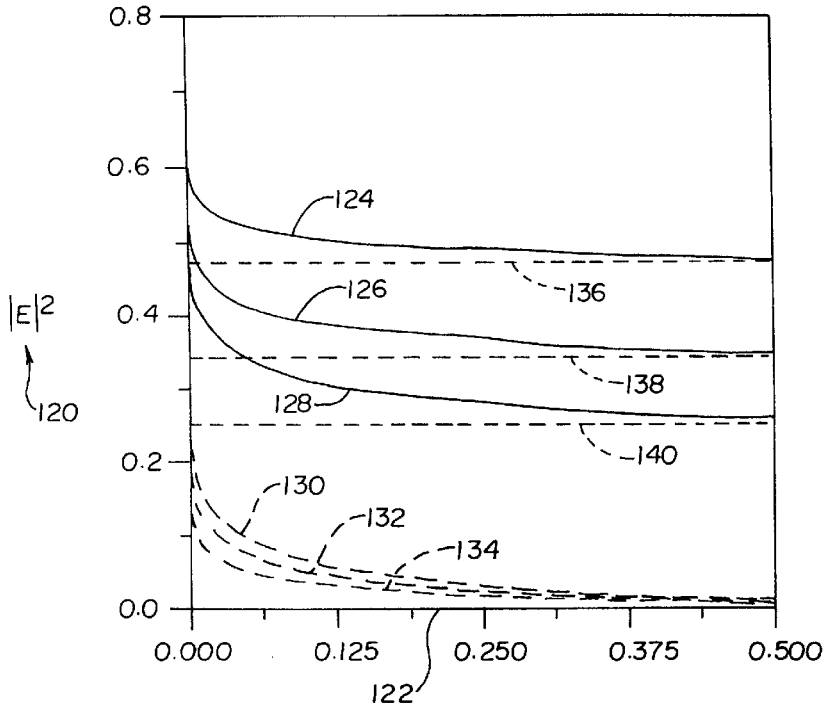
FIG. 25 is a graph of microwave energy distribution downstream of a grid comparing total energy, evanescent energy, and propagating energy.

Referring now to FIG. 25, the averaged microwave energy distribution behind the grid is plotted as $|E|^2$ 120 on the ordinate and distance from the grid 122 in cm on the abscissa. The top three curves are for total energy. The three straight line (horizontal) curves are for propagating modes and the bottom three curves are for evanescent modes. Curves 124, 134 and 136 correspond to a bridge width of 0.16 cm with an aperture size (diameter, in the case of circular apertures) of 2.38 cm. Curves 126, 132, and 138 correspond to a bridge width of 0.32 cm with an aperture size of 2.38 cm. Curves 128, 130 and 140 correspond to a bridge width of 0.5 cm with an aperture size of 2.38 cm.

In the design of a package for microwave popping of popcorn, it has been found desirable to have the strongest level of combined propagating and evanescent mode energy in the zone adjacent the grid for good popping performance, while at the same time, minimizing the amount of propagating mode energy progressing to the volume interior of the evanescent zone in the package to reduce scorching of the popped popcorn. It is therefore desirable to select an aperture size to optimize microwave energy transmission characteristics for a balanced performance of popped volume and scorch resistance. For a square aperture shape in a square lattice pattern, the optimum aperture size is believed to be in the range of ½ to 2 inches, and preferably about 1 inch for each side of the square aperture.

Figure 26:
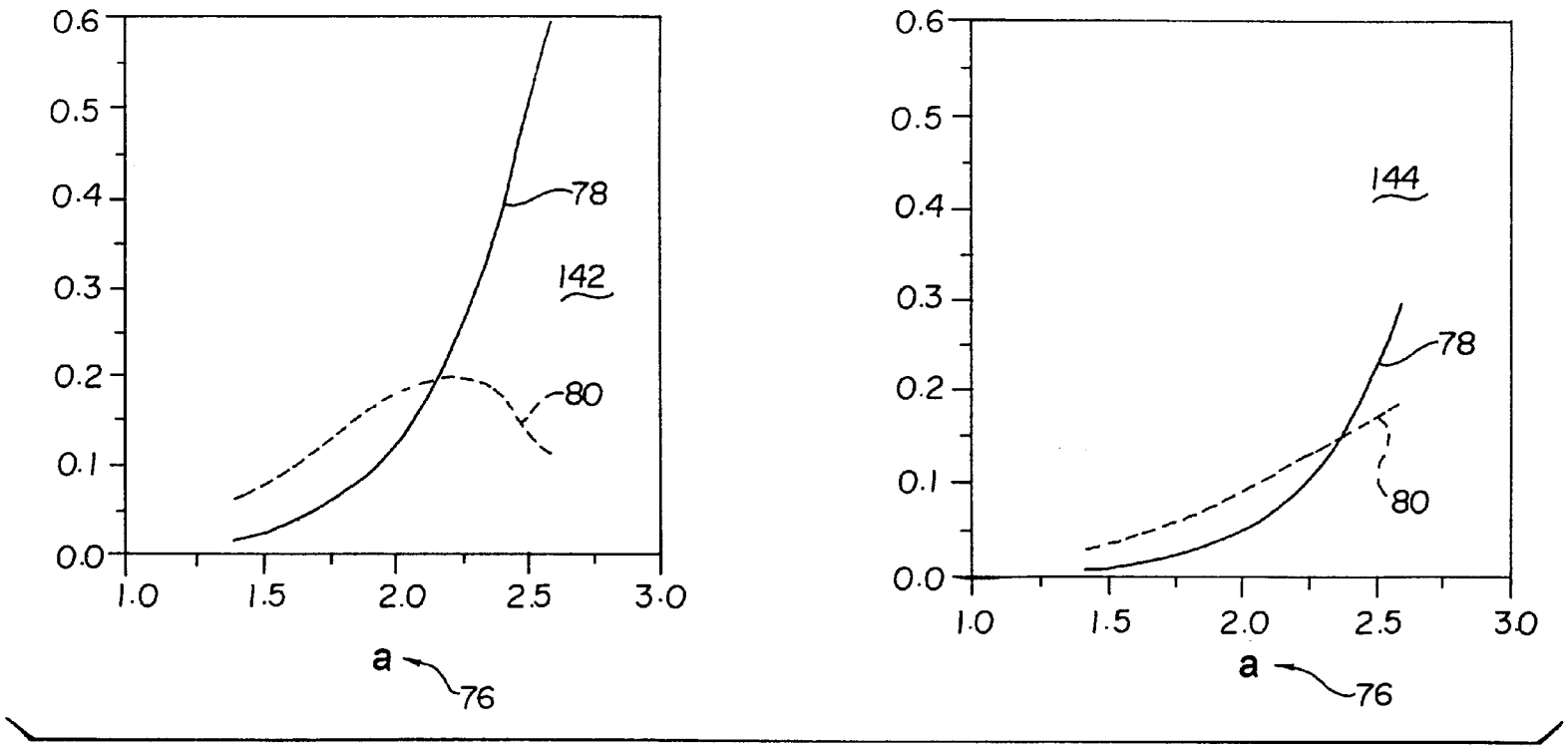
FIG. 26 is a pair of graphs comparing square shaped apertures to circular apertures in a square lattice.

Referring now to FIG. 26, the effect of changing the shape of individual apertures on microwave transmission through the grid may be seen for square and circular shaped apertures in a square lattice pattern. Using the model of a plane microwave incident in the normal direction to the metal grid indicates that for a given level of propagating mode energy, chart 142 illustrates the results obtained with square apertures in a square lattice. The center to center distance L 74 is 2.69875 cm for both charts. The relative propagating mode wave intensity is shown by curve 78 in chart or graph 142, while the evanescent mode wave intensity is shown by curve 80, with aperture size "a" 76 plotted along the abscissa. The effect of circular apertures is shown in a square lattice 68 (similar to the embodiment of sheet 70 shown in FIG. 17, except for the shape of the apertures) in chart 144. Here the relative intensity 78 of the propagating mode is substantially reduced from that of chart 142 for corresponding values of "a." Similarly, the magnitude (and characteristic shape) of the evanescent mode intensity 80 is altered by the change of aperture shape. It is to be understood that "a" 76 in chart 144 refers to the diameter of the circular apertures.

Figure 27:
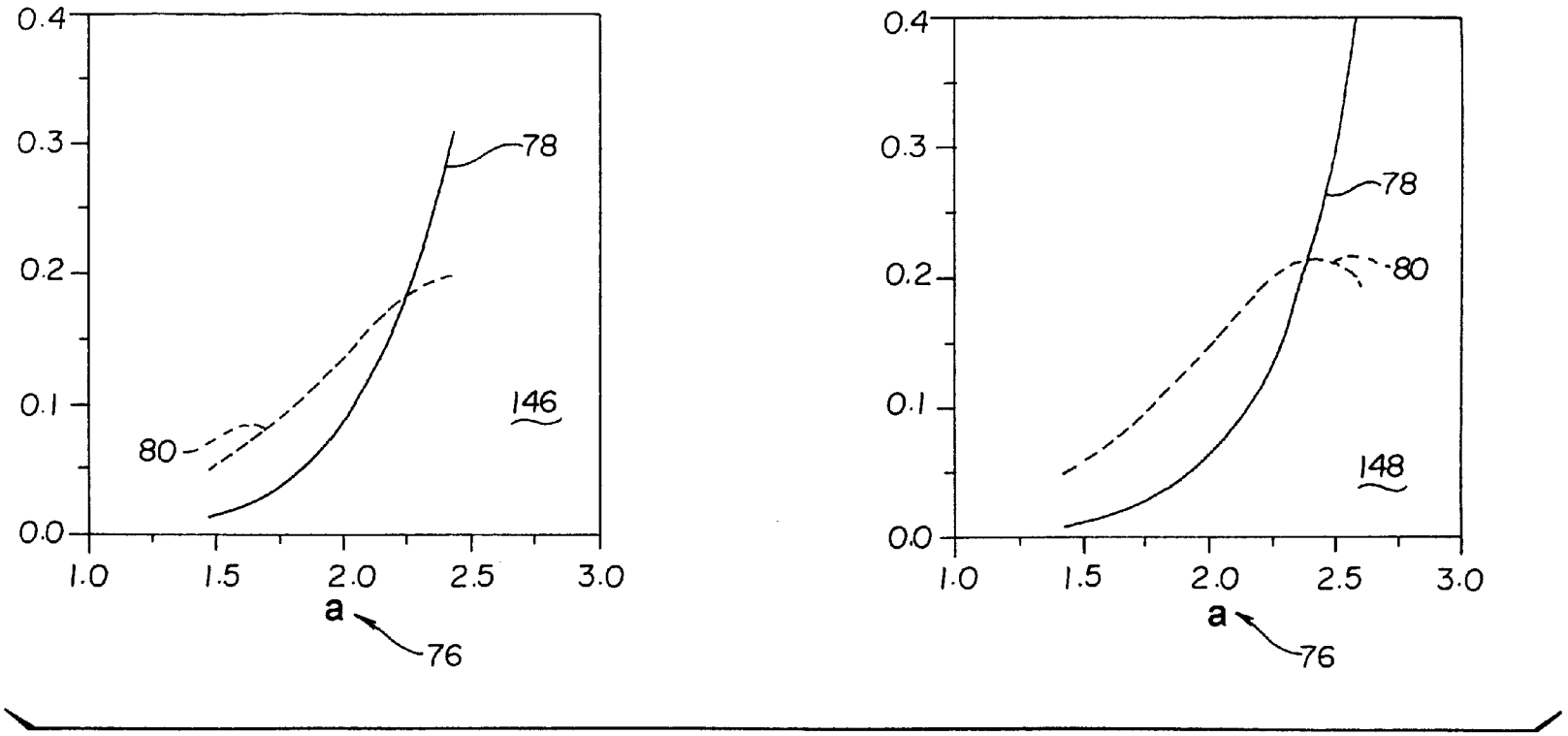
FIG. 27 is pair of graphs comparing hexagonal shaped apertures to circular apertures in a triangular lattice
Figure 29:
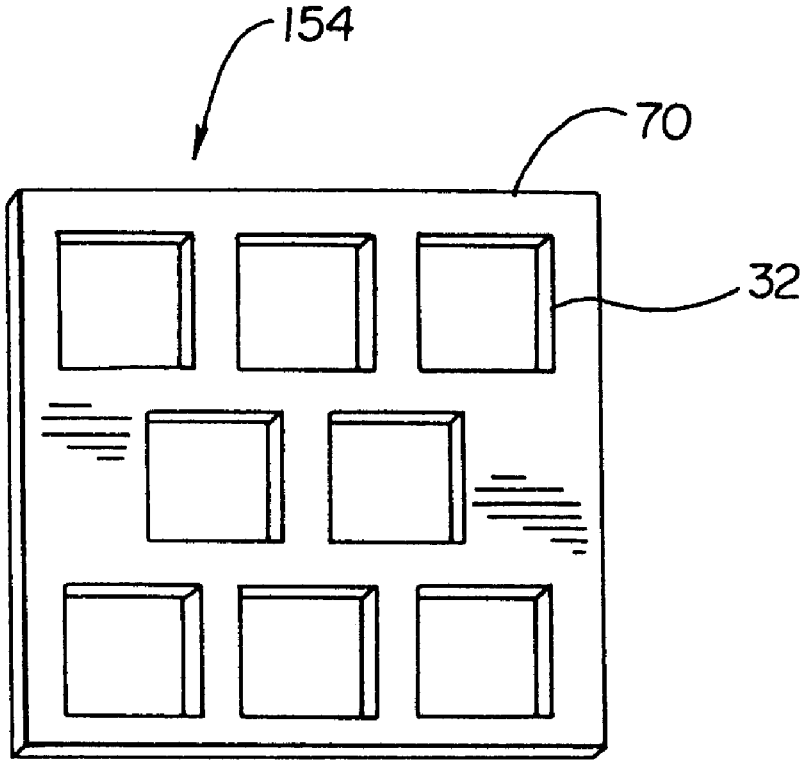
FIG. 29 is an example of a triangular lattice formed of apertures in a metal sheet.

Referring now to FIG. 27, the effect of changing the shape of individual apertures on microwave transmission through the grid may be seen for hexagonal and circular shaped apertures in a triangular lattice pattern. A triangular lattice pattern 154 is shown in FIG. 29 for square shaped apertures. Again using the model of a plane microwave incident in the normal direction to the metal grid indicates that for a given level of propagating mode energy, chart 146 illustrates the results obtained with hexagonal shaped apertures in a triangular lattice. The center to center distance L 74 is 2.69875 cm for both charts. The relative propagating mode wave intensity is shown by curve 78 in chart 146, while the evanescent mode wave intensity is shown by curve 80, with aperture size "a" 76 plotted along the abscissa. It is to be understood that "a" as used here, refers to the diameter of the circular apertures and to the minor "diameter" of the hexagonal apertures, i.e., the perpendicular distance between two opposing, parallel, sides. The effect of circular apertures is shown in a triangular lattice in chart 148. Here the relative intensity 78 of the propagating mode is substantially the same, although slightly reduced from that of chart 146 for corresponding values of "a." Interestingly, the magnitude (and characteristic shape) of the evanescent mode intensity 80 in charts 146 and 148 is very similar for "a" between 1.5 cm and about 2.3 cm. As is apparent, there is a pronounced maximum in the evanescent mode intensity 80 in chart 148. It is to be understood that "a" 76 in chart 148 refers to the diameter of the circular apertures.

Figure 28:
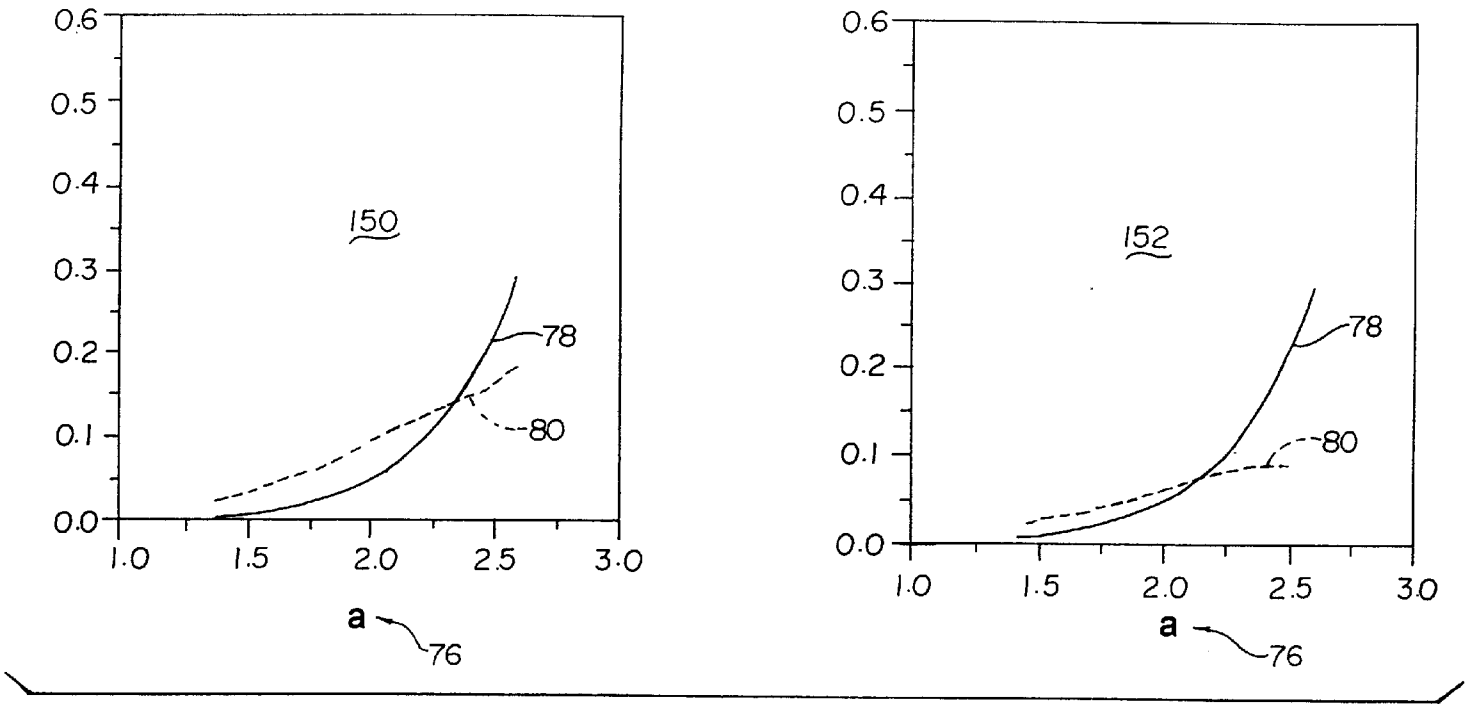
FIG. 28 is a pair of graphs comparing a square lattice to a triangular lattice, each having circular shaped apertures.

Referring now to FIG. 28, the effect of aperture pattern arrangement may be seen. In FIG. 28, chart 150 illustrates circular apertures in a square lattice, the same as in chart 144 of FIG. 26. Chart 152 illustrates circular apertures in a triangular lattice similar to the embodiment of sheet 70 shown in FIG. 29, except for the shape of the apertures. The square lattice arrangement delivers higher evanescent energy intensity 80 than the triangular lattice arrangement, but very close to the same propagating mode intensity 78.

Two experiments were performed to test the influence of grid design on microwave popcorn performance. A trapezoid-shaped box was constructed of steel and used to simulate the shield in a popcorn bag. The bottom of the box was open, but covered with a one of several metal grids, differing from each other in the size and geometry of openings in the grid. The dimensions of the box were as follows. The height was 15 cm, the top rectangle was 20 cm by 16 cm, the bottom rectangle was 15 cm by 11 cm, and the thickness of the steel was 1 mm. The box formed an inverted, truncated four-sided pyramidal structure with the 15 cm sides forming the bottom edges of the sides having the 20 cm top edge length. The replaceable grids were used to form the bottom wall. Two grid patterns were tested and compared: (1) Square holes in a square lattice with a hole size of 1" and a bridge width of 3/16" and (2) Round holes in a square lattice with a hole diameter of 1" and a bridge width of 3/16".

Pop-Secret brand microwave popcorn (as is widely available in retail food stores) was used in the experiments. The microwave oven used in the experiments was a Sharp 900 Carousel II oven. The oven was pre-heated by popping at least 3 bags of popcorn before starting the experiments.

Pop performance is characterized through three attributes: pop volume, scorch resistance and unpopped kernels. In each experiment, the popcorn was subjected to full power microwave energy for 90 seconds past the consumer end point. The consumer end point is defined as the point when popping has slowed to more than 5 seconds between two consecutive pops.

Pop volume was measured in cups. Unpopped kernels (UPK) was measured in terms of grams of popcorn that failed to pop during the experiment. Scorch resistance is measured using an Agtron calorimeter. The Agtron calorimeter device measures the color reading of the popped corns. Un-scorched popped popcorn kernels characteristically have high Agtron readings (usually above 80), while scorched popped popcorn kernels have lower Agtron readings (a reading below 75 is noticeable scorching, below 70 is considered severe scorching). Table 2 shows the experimental results.

TABLE 2

| Grid opening shape | Pop Volume (cups) | Agtron scorch resistance reading | UPK (grams) |
|---|---|---|---|
| Square holes | 2700 | 72.1 | 0.9 |
| Round holes | 2300 | 80.23 | 2.4 |

The experiments show that compared to the round hole grid, the square hole grid gives higher pop volume, less scorch resistance and less unpopped kernels. This is consistent with the prediction in FIG. 26 that both propagating wave and evanescent wave intensities are reduced when changing shape from square to round holes.

It is to be further understood that the present invention is suitable for selective heating of foods other than popcorn and other puffed foodstuffs. For example, and not by way of limitation, a filled pastry that gives off water vapor when heated, may be heated and a topping such as frosting may be melted using a food package according to the teachings of the present invention. In such an application, the filling may be prevented from being overheated while the outer surface of the foodstuff can be heated and even browned, if desired, using the evanescent penetration zone of the present invention to selectively heat an exterior region or surface of the foodstuff, preventing overheating by inflation of the package during microwave irradiation to remove the evanescent heating, all the while allowing a controlled amount of propagating energy to enter the package and heat the foodstuff simultaneously.

As another example, and not by way of limitation, the present invention may be used to selectively and controllably heat or cook a pizza using microwave irradiation, where the food package for the pizza may have relatively small apertures in a lower surface to admit evanescent energy only (or primarily) to the pizza crust below the toppings while the upper grid or region above the pizza food load may have apertures suitable for sufficient, but not excessive, heating or cooking of the toppings, followed by a movement of the upper grid away from the pizza (as a result of the water vapor generated) to prevent overheating of the toppings. This approach may be utilized with or without a susceptor to achieve desired browning of the crust, and to simultaneously achieve desired cooking of the toppings, without overcooking. This approach can benefit from the controlled introduction of conventional, propagating microwave energy along with the selective application of the evanescent energy.

The invention is not to be taken as limited to all of the details thereof as modifications and variations thereof may be made without departing from the spirit or scope of the invention.

What is claimed is:

1. Apparatus for controlling heating of a foodstuff with microwave energy comprising:

a. a food package having a microwave shielding layer with a plurality of apertures therein, with the apertures sized to permit entry of both evanescent and propagating microwave energy into the interior of the package;

b. a foodstuff contained in the food package with the foodstuff initially located in close proximity to the microwave shielding layer;

c. means for moving the microwave shielding layer away from close proximity to at least a portion of the foodstuff after the package and the foodstuff are irradiated with at least a predetermined amount of microwave energy such that the evanescent microwave energy entering the package is insufficient to over heat the foodstuff when the microwave shielding layer is moved out of close proximity to the foodstuff, while the propagating microwave energy continues to heat the foodstuff and the combination of evanescent microwave energy and propagating microwave energy is balanced to achieve a desired heating of the foodstuff.

2. The apparatus of claim 1 wherein water vapor is generated by the microwave energy and the means for moving the microwave shielding layer away from close proximity to at least a portion of the foodstuff is a water vapor barrier layer sufficiently impermeable to water vapor and operative to inflate the package in response to the generation of water vapor.

3. The apparatus of claim 2 wherein the foodstuff is popcorn.

4. The apparatus of claim 1 wherein the food package further comprises a microwave susceptor located interior of the microwave shielding layer.

5. The apparatus of claim 1 wherein the food package further comprises a microwave susceptor located exterior of the microwave shielding layer.

6. The apparatus of claim 1 wherein the food package further comprises a septic layer located adjacent the microwave shielding layer.

7. The apparatus of claim 1 wherein the plurality of apertures extend substantially across the entire food package.

8. The apparatus of claim 1 wherein the plurality of apertures extend across a predetermined, limited region of the food package.

9. The apparatus of claim 8 wherein the predetermined, limited region includes non-contiguous sub-regions.

10. The apparatus of claim 9 wherein the predetermined, limited region extends over more than one surface of the food package.

11. The apparatus of claim 8 wherein the limited region is generally at least congruent to the foodstuff as it exists prior to heating.

12. A method of controlling heating of a foodstuff with microwave energy comprising the steps of:

a. providing a food package having a microwave shielding layer with a plurality of apertures therein, where the apertures are sized to permit evanescent microwave energy and a controlled, limited amount of propagating microwave energy into the interior of the package;

b. initially locating a foodstuff within the food package in close proximity to the microwave shielding layer;

c. irradiating the package and foodstuff with microwave energy; and d. moving the microwave shielding layer away from close proximity to at least a portion of the foodstuff after the package and the foodstuff is irradiated with at least a predetermined amount of microwave energy such that the evanescent microwave energy is insufficient to over heat the foodstuff when the microwave shielding layer is moved out of close proximity to the foodstuff, while the propagating microwave energy continues to heat the foodstuff.

13. The method of claim 12 wherein water vapor is generated by the microwave irradiation.

14. The method of claim 13 wherein the water vapor expands the package to move the microwave shielding layer away from close proximity to at least a portion of the foodstuff after the package and the foodstuff is irradiated with at least a predetermined amount of microwave energy.

15. The method of claim 14 wherein the foodstuff is popcorn.

16. The method of claim 12 wherein the step of providing a plurality of apertures in the microwave shielding layer further comprises locating the plurality of apertures to at least a predetermined, limited region of the food package.

17. The method of claim 16 wherein the step of providing a plurality of apertures in the microwave shielding layer further comprises locating the plurality of apertures generally at least congruent to the foodstuff as it exists prior to heating.

18. The method of claim 12 wherein step a further comprises providing the plurality of apertures across substantially all of the food package.

19. The method of claim 12 further comprises providing a susceptor in the food package, wherein the microwave shielding layer has apertures adjacent the susceptor.

20. The method of claim 12 wherein step a further comprises providing the food package with a water vapor barrier layer substantially impermeable to water vapor.

21. The method of claim 12 wherein step a further comprises providing the food package with a septic layer sufficient to maintain a sanitary environment for the interior of the food package.

22. A food package apparatus for controlling the entry of evanescent and propagating microwave energy to the interior of the package apparatus comprising:

a. a microwave shielding layer extending over at least a portion of the food package apparatus with a plurality of apertures in a predetermined region thereof, with the apertures sized to admit and control both evanescent microwave energy and propagating microwave energy into the interior of the package apparatus, b. a foodstuff contained in the food package apparatus with the predetermined region of the microwave shielding layer initially located in close proximity to at least a portion of the foodstuff;

c. means for moving the predetermined region of the microwave shielding layer away from close proximity to the portion of the foodstuff after the package apparatus and the foodstuff is irradiated with at least a predetermined amount of microwave energy such that the evanescent microwave energy passing through the predetermined region of the microwave shielding layer is insufficient to over heat the foodstuff after the microwave shielding layer is moved out of close proximity to the portion of the foodstuff, while the propagating microwave energy continues to heat the foodstuff.

23. The food package apparatus of claim 22 wherein water vapor is generated by the microwave energy and the means for moving at least the predetermined region of the microwave shielding layer away from close proximity to at least a portion of the foodstuff is a water vapor barrier layer sufficiently impermeable to water vapor and operative to provide relative movement to increase the spacing between the foodstuff and at least a part of the predetermined region of the microwave shielding layer.

24. The food package apparatus of claim 23 wherein the foodstuff is popcorn.

25. The food package apparatus of claim 22 wherein the food package apparatus further comprises a microwave susceptor.

26. The food package apparatus of claim 22 further comprising a septic layer located adjacent the microwave shielding layer.

27. The food package apparatus of claim 22 wherein the predetermined region containing the plurality of apertures extends substantially across the entire food package apparatus.

28. The food package apparatus of claim 22 wherein the predetermined region containing the plurality of apertures includes non-contiguous sub-regions.

29. The food package apparatus of claim 28 wherein the predetermined region including the non-contiguous sub-regions extends over more than one surface of the food package apparatus.

30. The food package apparatus of claim 22 wherein the predetermined region is generally at least congruent to the foodstuff as it exists prior to heating.

31. A microwave popcorn package for popping popcorn in a microwave oven comprising:

a. a bag having:

i. a microwave shielding layer with a plurality of apertures therein with the apertures sized to permit both evanescent microwave energy and a controlled, limited amount of propagating microwave energy to enter the interior of the bag, and ii. a water vapor barrier layer generally impermeable to water vapor; and b. a mass of popcorn in the bag with the popcorn located adjacent the apertures in the microwave shielding layer prior to popping the popcorn;

wherein the bag is initially in a deflated condition, permitting entry of both the evanescent and propagating microwave energy sufficient to cause the popcorn to pop, and wherein the bag is subsequently inflated by the water vapor resulting from the popcorn popping, creating an internal volume of the bag shielded from the evanescent microwave energy to reduce scorching of the popped popcorn in the shielded volume.

32. The package of claim 31 wherein the bag further includes:

iii. a susceptor located adjacent the mass of popcorn and exposed to microwave irradiation when the bag is placed in an operating microwave oven.

33. The package of claim 32 wherein the bag further includes:

iv. a septic layer to provide a sanitary environment interior of the bag.

* * * * *